US005341343A

United States Patent [19]

Aske

[11] Patent Number: 5,341,343

[45] Date of Patent: Aug. 23, 1994

[54] UNDERWATER EXPLOSIVE ACOUSTIC SIGNATURE DEVICE

[75] Inventor: Robert L. Aske, St. Louis Park, Minn.

[73] Assignee: Alliant Techsystems, Inc., Edina, Minn.

[21] Appl. No.: 41,560

[22] Filed: Apr. 2, 1993

[51] Int. Cl.[5] ..... H04K 3/00

[52] U.S. Cl. ..... 367/1; 181/116; 181/118; 102/393; 102/394; 367/145

[58] Field of Search ..... 367/1, 145; 181/116, 181/118; 102/393, 394, 402; 89/1.1, 1.11

[56] References Cited

U.S. PATENT DOCUMENTS

| | | | |
|---|---|---|---|
| 3,938,438 | 2/1976 | Anderson et al. | 102/393 |
| 4,183,302 | 1/1980 | Schillreff | 367/1 |
| 4,633,969 | 1/1987 | Palmer | 367/145 |
| 4,975,890 | 12/1990 | Wolf et al. | 367/145 |
| 5,003,515 | 3/1991 | Will et al. | 367/145 |
| 5,175,712 | 12/1992 | Vaccaro et al. | 367/145 |

OTHER PUBLICATIONS

Excerpt on the ADC MK2 MOD O, by Bernard Blake, *Jane's Underwater Warfare Systems,* p. 1., 1989–1990.

Excerpt on the Sonar 2066 Bandfish, by Bernard Blake, *Jane's Underwater Warfare Systems,* p. 1., 1989–1990.

*Primary Examiner*—J. Woodrow Eldred

*Attorney, Agent, or Firm*—Merchant, Gould, Smith, Edell, Welter & Schmidt

[57] ABSTRACT

An explosive actuated acoustic device emits sound to be used in torpedo countermeasures. Numbered devices are delivered over an extended area and sink through the water. The devices are actuated at different times as they sink, to provide sound masking over an extended period of time. The devices also include safety devices which prevent premature actuation from jarring or jolting and from impact with the water.

26 Claims, 4 Drawing Sheets

UNDERWATER EXPLOSIVE ACOUSTIC SIGNATURE DEVICE

BACKGROUND OF THE INVENTION

1. Field of the Invention

The present invention relates to an explosive actuated acoustic device, and in particular, to an acoustic device used underwater.

2. Description of the Prior Art

Acoustic devices for use underwater, such as acoustic devices for preventing detection of ships by acoustic torpedoes or other sound sensitive devices are well known. The devices are deployed as a torpedo countermeasure to prevent a homing system from finding a ship. It is desired that such devices are easily deployed to cover an extended area at a number of depths rather than emitting sound from a point source, in order to provide better protection for the ships. In addition to extended area, it is also desired that acoustic systems have sound emitted over a period of time for additional protection.

Previous acoustic devices have been electrically actuated, thereby requiring an electric power supply. In addition, the previous devices have emitted sound from a point source suspended in the water, giving very little coverage for masking purposes. Since the devices are suspended in water, flotation devices are required as part of the design, adding to complexity and cost. Types of flotation devices used include cables, flotation bottles, flotation bags, and hover motors equipped with propellers to provide positive and negative thrust, all of which may be unreliable at providing proper depth for the acoustic devices. When such devices are launched from a vessel, a parachute is required to ensure that the impact with the water does not cause the devices to malfunction or actuate prematurely. Another problem is that the sound generated by electronic means may not be sufficient for covering the sound of ships. Since the acoustic devices are electric, the reliability decreases in the wet conditions in which the devices are deployed.

Acoustic devices must also be safe to use. The devices may be accidentally actuated prematurely. Movement of the launch vehicle may jar the devices if safety features are not incorporated, causing the acoustic device to explode prematurely. This may start a chain reaction wherein all acoustic devices in the vehicles are detonated.

The acoustic devices could also be actuated upon impact with the water. An explosive-actuated acoustic device should incorporate safeguards to prevent premature actuation from impact with the water.

It can be seen then, that an improved system for acoustic torpedo countermeasures is needed. An improved system should cover a sufficient area, for an extended period, at a satisfactory sound level. In addition, such an acoustic system should be compact, easily deployable, and reliable under various conditions. Such a system should also incorporate safety features to prevent premature actuation.

SUMMARY OF THE INVENTION

The present invention is directed to an explosive-actuated acoustic device such as may be used for torpedo countermeasures. According to the present invention, a multiplicity of acoustic devices are transported within a launch vehicle to a pre-designated area for deployment. The acoustic devices are released from the launch vehicle and fall over the area. The devices in the preferred embodiment have a fletner rotor design which provides spinning stability and aerodynamic lift while the devices fall through the air. Aerodynamic lift provides for dispersion causing the devices to impact over a large area. The devices also include mechanisms to prevent detonation upon impact with water and early detonation from jarring or other shock.

As the devices sink through the water, the explosive mechanisms of the devices are actuated at spaced intervals to provide a continued sound generation. The devices are actuated at different depths and at different times to cover both an extended area as well as an extended period of time for torpedo countermeasures. Each acoustic device includes a piston sliding within a body of the device. At an opposite end of the body there is positioned a detonator and a detonator holder. The piston includes a firing pin which strikes the detonator as the piston slides along the body. A column supports the piston so that it does not engage the detonator and cause actuation. As the devices sink through the water, the external pressure applies force to the piston to urge it toward the detonator. The columns are made from materials and have diameters such that at a predetermined pressure, the force in the piston will cause the column to bend or buckle so that the sliding piston is forced along the body to strike the detonator.

The present invention utilizes a plurality of column materials and column diameters so that different strengths for columns in the different devices are achieved. In this manner, the individual devices are actuated at different depths as they sink through the water. In addition to changing the strength of the support columns, the actuation time may be varied by changing the sink rates of each of the individual devices. This can be achieved by having the different acoustic devices have bodies which are made of different materials so that heavier devices will sink faster while the lighter devices will sink at a slow rate. With the plurality of column strengths and sink rates, the actuation of the acoustic devices covers an extended period of time.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference numerals and letters indicate corresponding elements throughout the several view.

DETAILED DESCRIPTION OF THE PREFERRED EMBODIMENT(S)

Figure 1:
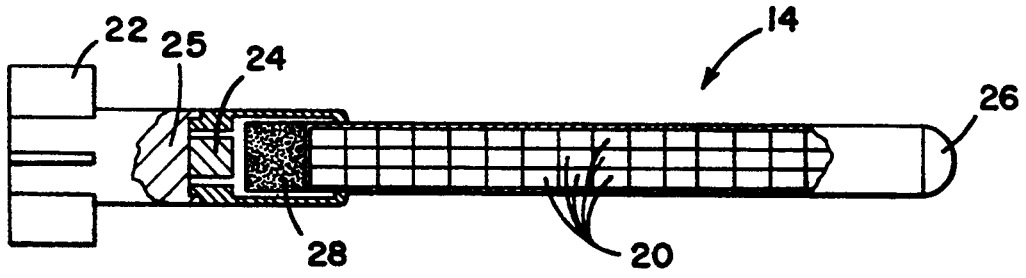
FIG. 1 shows a diagrammatic view of deployment of an acoustic torpedo countermeasure system according to the principles of the present invention.

Referring to the drawings, and in particular to FIG. 1, a method of deploying an explosively-actuated acoustic device 20 is shown. The acoustic devices 20 are extremely compact and deployed in a launch vehicle 14 from a ship 10 having a launcher 12. The ship 10 may use any of various types of launch systems 12 which are adaptable to the launch vehicle 14.

Figure 2:
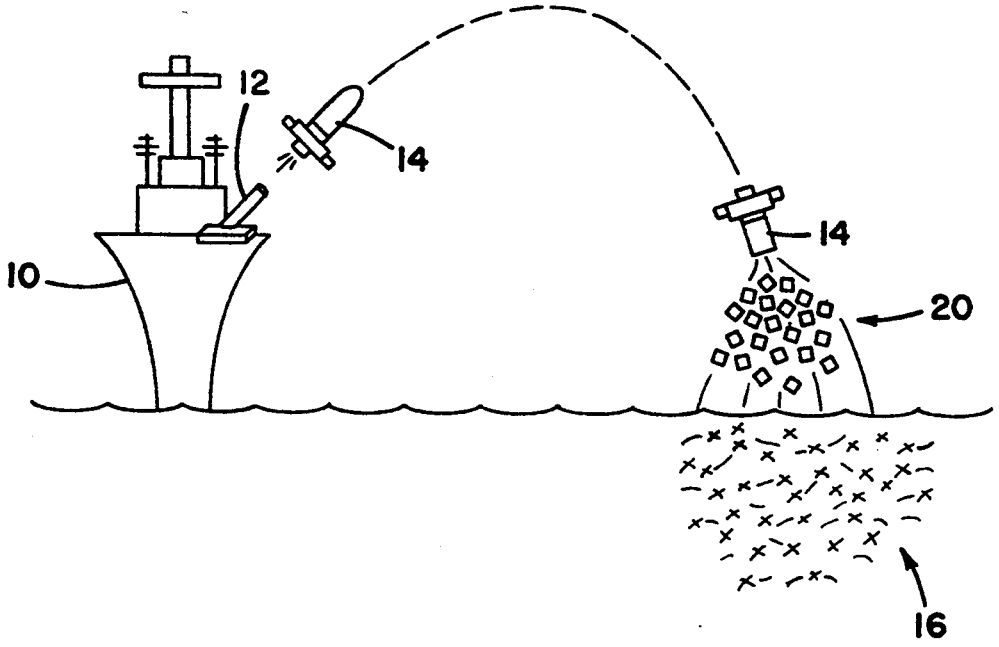
FIG. 2 shows a side diagrammatic view of a delivery vehicle for the system shown in FIG. 1.

The launch vehicle 14 is directed at a target area, generally designated 16, whereat the acoustic devices 20 are actuated for torpedo countermeasures. The acoustic devices 20 are spread from one or more of the launch vehicles 14, also shown in FIG. 2, in a pattern covering an extended area 16 to provide improved protection for the ship or other potential targets. The launch vehicle 14 typically includes tail fins 22 for guidance and improved flight characteristics. The vehicle also has a rocket motor 25 or other means of propulsion. In addition, the launch vehicle 14 has an end cap 26 which may be ejected. The vehicle is designed to hold a large number, typically on the order of 1,200, acoustic devices 20. The acoustic devices 20 may be expelled from the vehicle 14 by a charge or other means.

Referring again to FIG. 1, when the launch vehicle 14 has reached a position over the target area 16, the end cap 26 is ejected by a propulsion charge, 28, which is initiated by a time delay fuze 24, so that the launch vehicle 14 expels the acoustic devices 20 over the target area 16. The acoustic devices 20 then fly downward, rotating as they fall to improve aerodynamic stability and to generate aerodynamic lift causing them to disperse over a wide target area 16, as explained hereinafter. The acoustic devices 20 then sink through the target area 16 and are actuated by pressure at different depths and at different times, as explained further hereinafter.

Figure 3:
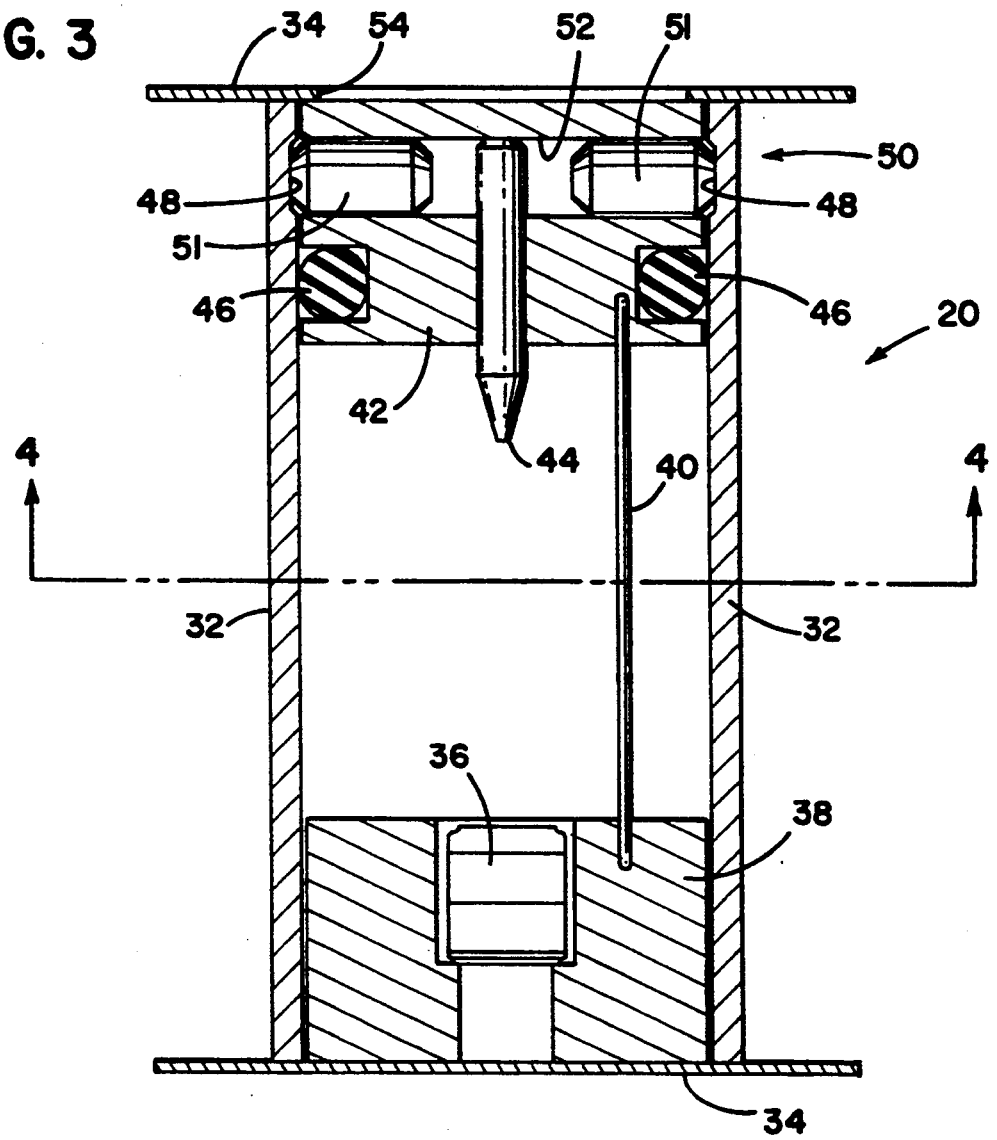
FIG. 3 shows a side sectional view of an explosively actuated acoustic device according to the principles of the present invention.
Figure 4:
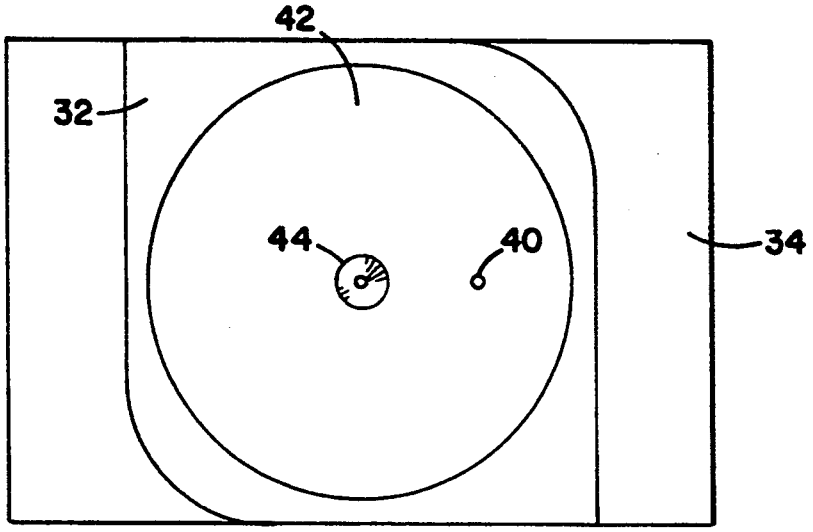
FIG. 4 shows a sectional view of the explosively actuated acoustic device taken along line 4—4 of FIG. 3.

Referring now to FIG. 3, the acoustic device 20 is shown in greater detail. The acoustic device includes a body 32 having end plates 34 mounted thereon. As shown in FIG. 4, the body 32 has a fletner rotor-type cross section which, when combined with opposed end plates 34, imparts a rotational motion on the acoustic device 20 while descending. This provides greater stability and lift when the devices 20 are descending through the air.

The acoustic device 20 includes a detonator 36 and a detonator holder 38 at a first end of the device which cause the explosion to create the sound for the device 20. The detonator 36 is actuated by a firing pin 44 mounted on a sliding piston 42 initially positioned at an opposite end of the device 20. The piston 42 includes an 0-ring 46 to provide a tight seal against the body 32. In addition, the piston 42 may have a spin lock 50 including lock weights 51 which are mounted in a sliding passage 52 to prevent premature actuation, as explained hereinafter. The piston 42 is held in place by a column 40 extending between the detonator holder 38 and the piston 42.

In operation, the acoustic devices 20 are expelled from the launch vehicle 14 when the launch vehicle reaches a position above the target area 16. The fletner rotor-shape of the body 32, along with the end plates 34, imparts rotational motion on each of the acoustic devices 20 including the spin lock 50. The rotation causes the lock weights 51 in the piston 42 to experience centrifugal force which pushes the weights 51 radially outward along the sliding passage 52. The weights 51 slide to engage a groove 48 in the body 32. At this point, the piston 42 cannot slide along the body 32 to strike the detonator 36, as the weights 51 engage the edge of the groove 48. When the acoustic devices 20 hit the water, the rotation slows substantially or stops while the acoustic devices 20 sink. Therefore, with little or no centrifugal force, the weights 50 are not forced radially outward to engage the groove 48 and the weights 51 do not prevent the piston 42 from sliding along the body 32.

Also preventing the piston 42 from sliding along the body 32 is the support column 40. As the acoustic devices 20 sink through the water, the pressure increases. The pressure of the water engages the piston 42 through opening 54. When the pressure is great enough, the column 40 supporting the piston 42 will bend or buckle so that the piston 42 is no longer restrained. The pressure from the water forces the piston 42 along the body 32 until the firing pin 44 strikes the detonator 36. This causes an explosion and produces the sound which is emitted from the device.

It can be appreciated that the pressure at which each of the devices 20 is actuated will depend on the strength of the column 40 supporting the piston 42. Therefore, the diameter of the column 40 may be varied to increase or decrease the strength of the column 40, therefore changing the pressure at which the device 20 is actuated. This also varies the depth at which the column 40 will break and at which the device 20 is actuated. In addition to changing the diameter of the column 40, the material of the column 40 may be varied as well. For instance, some columns 40 may be made of steel members while others may be made out of a softer aluminum material. By varying both the material and the diameter of the column 40, a multitude of depths may be obtained at which the devices 20 of a payload are actuated.

In addition to varying the depth by changing the parameters of the support column 40, the devices 20 may be modified in an additional manner so that they are actuated at different times. By changing the materials of which the body 32 is made of, the devices 20 will sink at different rates. Therefore, the faster sinking devices 20 will reach their actuation depth sooner than those which are made of lighter materials. It can be appreciated that by combining different body materials, different column diameters and different column materials, a multitude of actuation times can be obtained for each payload of devices 20.

Figure 5:
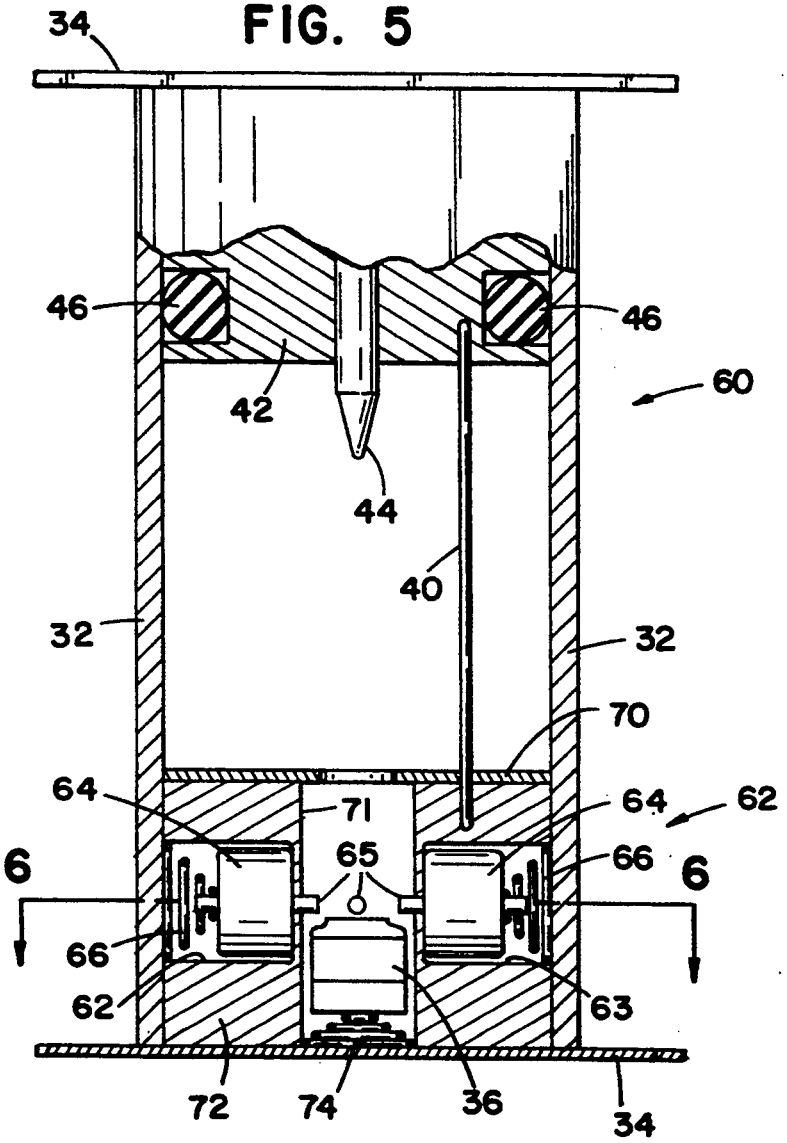
FIG. 5 shows a side sectional view of a second embodiment of an explosively actuated acoustic device according to the principles of the present invention.
Figure 6:
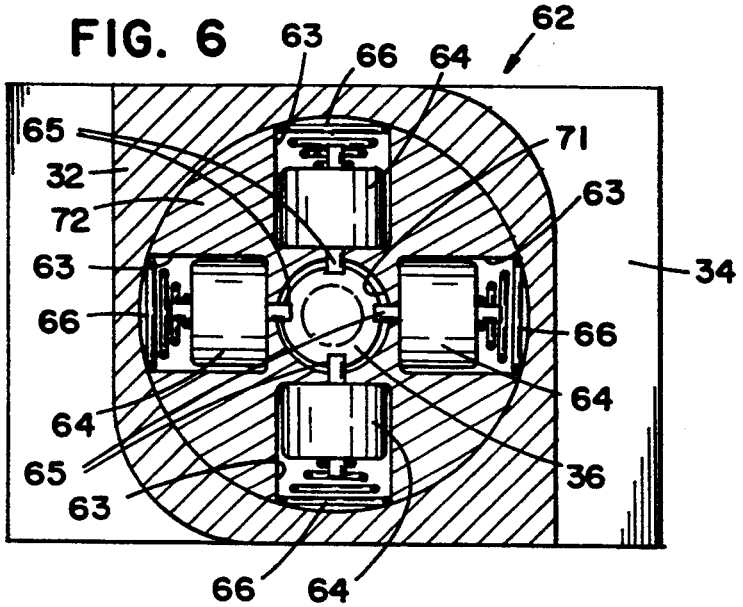
FIG. 6 shows a sectional view of the embodiment of FIG. 5 taken along line 6—6.

In FIG. 5, there is shown an alternative embodiment of the acoustic device, generally designated 60. The acoustic device 60 includes a safety device 62 for preventing premature detonation in addition to the column 40 and the sliding weights 50. The safety device 62 include four centrifugal weights 64 held in the position shown in FIG. 6 by four conical weight springs 66. When the device is not spinning, the detonator 36 is held away from the firing pin 44 by the four conical weight springs 66 and loaded centrifugal weights 64. The detonator 36, centrifugal weights 64 and the conical weight springs 66 are assembled into an alternative detonator holder 72. If the column 40 prematurely bends or buckles, the detonator 36 will not function because the firing pin 44 is shorter than the space 68 between the detonator 36 and a plate 70 on the detonator holder 72, as shown in FIG. 5. The detonator is held in the safety position by pins 65 on the weights 64 which extend into a detonator shaft 71.

Figure 7:
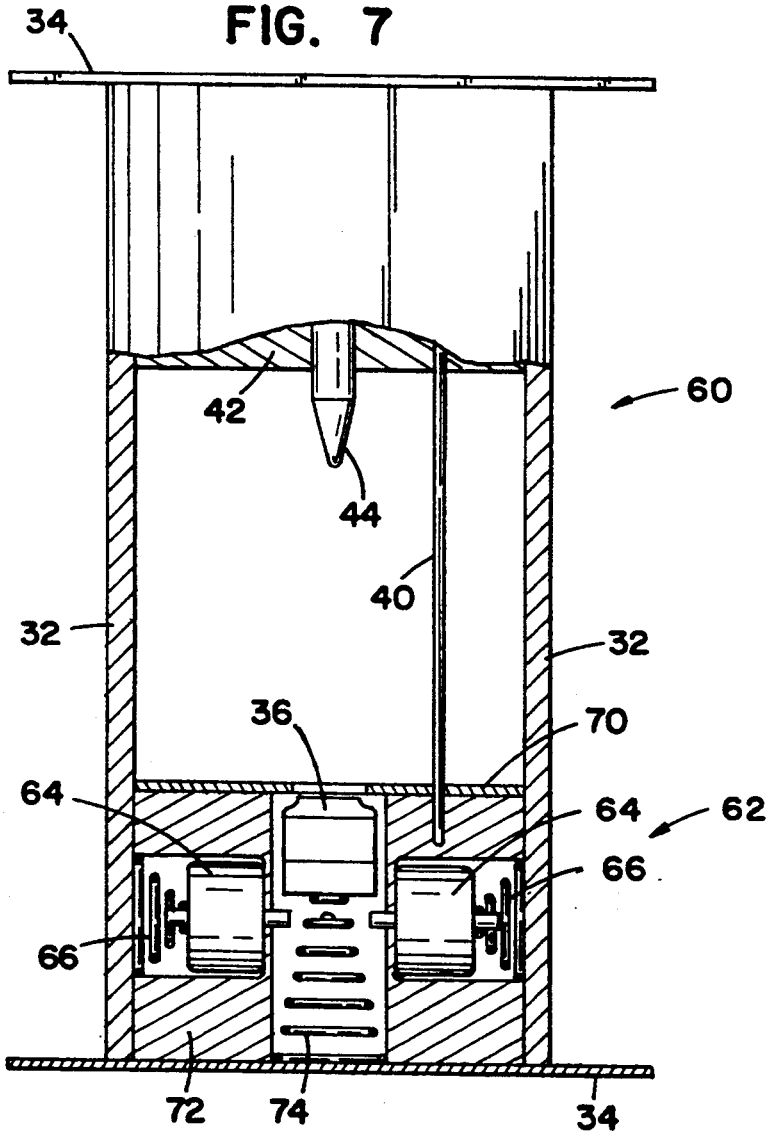
FIG. 7 shows a side sectional view of the device shown in FIG. 5 after the device has impacted water when its spin rate is reduced to a low value; and, FIG. 8 shows a side sectional view of the device shown in FIG. 5 when it is spinning during flight through the air.
Figure 8:
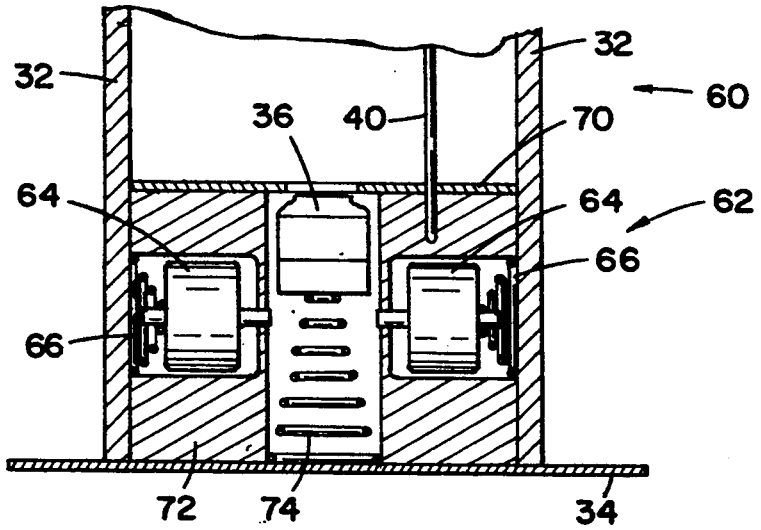

The acoustic device 60 has a fletner rotor design which provides stability and aerodynamic lift while it falls through the air. Aerodynamic lift is caused by the devices spinning up. This spinning action causes each of the four centrifugal weights 64 to move radially outward along passages 63 against the conical weight springs 66. When all four centrifugal weights have moved radially outward and the pins 65 have cleared the central shaft 71, a conical detonator spring 74 forces the detonator 36 to move forward against the plate 70, as shown in FIG. 8. After water impact in the target area 16, the spin is reduced to a very low value, allowing the conical weight springs 66 to force each centrifugal weight 64 into the position shown in FIG. 7. The detonator 36 is now supported at the forward position by the four pins 65 as it sinks in the water, as shown in FIG. 7.

As the devices 60 sink through the water, the explosive mechanisms of the devices are actuated at spaced intervals to provide a continued sound generation, as in the embodiment shown in FIG. 3. In the alternative embodiment of the acoustic device 60, the column 40 bends or buckles at a predetermined pressure so that the sliding piston 42 is forced along the body, causing the firing pin 44 to strike the detonator 36 which is held in the forward position by the conical detonator spring 74 and the four centrifugal weights 64, as shown in FIG. 7. In this manner, the safety device 62 prevents premature actuation while allowing normal operation of the acoustic device 60 after it has been launched and expelled. It can be appreciated that two independent environments, hydrostatic pressure on the sliding piston 42, and spin to allow the detonator 36 to move forward in position, are required with this embodiment before sound generation can occur. Four centrifugal weights 64 and conical weight springs 66 are shown because it has been found that this is the number needed to survive standard military rough handling requirements.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An explosive actuated acoustic apparatus for deployment in water, comprising a multiplicity of explosive actuated acoustic devices, wherein the acoustic devices include means for dispersing the devices over an extended area and wherein the multiplicity of acoustic devices have a plurality of sink rates for distributing activation of the acoustic devices over an extended period of time.

2. An explosive actuated acoustic apparatus according to claim 1, further comprising means for delivering the acoustic devices to a position over the extended area.

3. An explosive actuated apparatus according to claim 1, further comprising means for preventing early actuation of the devices.

4. An explosive actuated apparatus according to claim 1, wherein the means for distributing activation of the acoustic devices over a period of time comprises the multiplicity of acoustic devices having a plurality of sink rates.

5. An explosive actuated apparatus for deployment in water comprising a multiplicity of explosive actuated devices, wherein each of the acoustic devices comprises:

a body having opposed ends and end plates covering the ends;

a detonator located within the body;

a piston sliding within the body, the piston including means for actuating the detonator;

a column supporting the piston within the body;

means for dispersing the devices over an extended area; and means for distributing activation of the acoustic devices over an extended period of time.

6. An explosive actuated acoustic apparatus according to claim 5, wherein the acoustic devices have a plurality of different column strengths.

7. An explosive actuated acoustic apparatus according to claim 1, wherein the dispersing means comprises an acoustic device having a body shaped like a fletner rotor, imparting rotational motion to the devices.

8. An explosive actuated apparatus according to claim 1, wherein the acoustic devices include explosive sound-generating means.

9. An explosive actuated apparatus according to claim 1, further comprising pressure sensitive actuation means.

10. An explosive actuated apparatus according to claim 2, wherein the acoustic devices are transported in a launch vehicle.

11. An acoustic device according to claim 6, further comprising means for preventing detonation while the device rotates.

12. An explosive actuated acoustic device for creating sounds underwater, comprising:

a body having opposed ends and end plates cover the ends;

a detonator located within the body;

a piston sliding within the body, the piston including means for actuating the detonator;

a column supporting the piston within the body; and spin lock means for preventing premature actuation.

13. An explosive actuated acoustic device according to claim 12, further comprising spin lock means for preventing premature actuation.

14. An apparatus according to claim 12, further comprising a spin lock means for preventing premature activation, the spin lock means comprising a sliding weight, a slide passage, and a groove formed on an inner portion of the body, wherein centrifugal force urges the weight radially outward along the passage to engage the groove and prevent the piston from sliding.

15. An acoustic device for creating sounds underwater, comprising: